US005277476A

United States Patent [19]

Caldwell

[11] Patent Number: 5,277,476

[45] Date of Patent: Jan. 11, 1994

[54] KNOCKDOWN ARTICLE OF FURNITURE

[76] Inventor: John Caldwell, 1829 Warwick Rd., San Marino, Calif. 91108

[21] Appl. No.: 899,552

[22] Filed: Jun. 16, 1992

[51] Int. Cl.[5] ..... A47C 7/00

[52] U.S. Cl. ..... 297/440.1; 297/218; 297/440.13

[58] Field of Search ..... 297/440, 442, 443, 444, 297/218, 219

[56] References Cited

U.S. PATENT DOCUMENTS

| | | | |
|---|---|---|---|
| 3,870,366 | 3/1975 | Rogers | 297/440 |
| 3,891,267 | 6/1975 | Taylor | 297/440 X |
| 3,989,300 | 11/1976 | Heumann | 297/440 |
| 4,828,324 | 5/1989 | Putnam | 297/440 |
| 5,080,438 | 1/1992 | Moyer | 297/444 X |

FOREIGN PATENT DOCUMENTS

| | | | |
|---|---|---|---|
| 1200957 | 12/1959 | France | 297/440 |

*Primary Examiner*—Laurie K. Cranmer
*Attorney, Agent, or Firm*—Donald D. Mon

[57] ABSTRACT

An article of furniture which can readily be assembled from simple structural components with minimum tools. The article of furniture comprises a seat rail frame and a pair of end panels. The seat rail frame includes a pair of parallel spaced apart linear seat rails and a pair of parallel end plates rigidly fixed to the seat rails in a rectangular configuration. The end plates are normal to the seat rails. A support member, such as a seat or a table, has a pair of grooves in the bottom surface for fitting over the rails and is secured thereto by attachment members. The length of the rails can be made shorter or longer depending on how many support members are to be supported on the seat rails.

9 Claims, 4 Drawing Sheets

KNOCKDOWN ARTICLE OF FURNITURE

FIELD OF THE INVENTION

An article of furniture which can readily be assembled from simple structural components with minimum tools.

BACKGROUND OF THE INVENTION

Furniture is frequently sold only partially assembled, or in pieces which are not yet joined even as sub-assemblies. The objectives are to reduce the bulk of the article when shipped from the factory, and to reduce in-factory labor, both of which can importantly reduce the cost and sales price of the article.

While such knocked-down furniture is more frequently encountered in outlets that sell furniture for the home, it also can be important for institutional types of furniture, such as seating for medical waiting rooms, airport lounges, and the like. In such situations, the intended dimensions of the final assembly may be well beyond that which conveniently can be transported.

In addition, in institutional seating there is considerable wear caused by frequent usage. This wear becomes evident when joints become loose, especially when assembly means such as commonly used in home furnishings are employed. The wear also becomes apparent on the upholstery and covers.

It is an object of this invention, in addition to convenience in assembly, to provide more rugged assemblies that are able to resist very frequent usage, and to provide means conveniently to replace covers on the furniture, all requiring little or no mechanical skill.

It is another object of this invention to provide a construction in which a wide variety of seating arrangements can be supplied with a minimum number of different parts.

BRIEF DESCRIPTION OF THE INVENTION

An article of furniture according to this invention has as its basic a seat rail frame and a pair of end panels. The seat rail frame includes a pair of parallel spaced apart linear seat rails and a pair of parallel end plates rigidly fixed to the seat rails in a rectangular configuration. The end plates are normal to the seat rails. The end frames are adapted to rest on a floor, and each include a planar region against which an end plate are brought to bear. Attachment means holds the end plates to and strongly against the end frames, so the resulting structure is rigid, with the seat rails extending parallel to the floor.

A support member, such as a seat or a table, has a top and a bottom surface. A pair of grooves in the bottom surface receives and fits over the respective rails, and a retention means is passed through the seat rails and into the support member to hold the support member to the rails in the installed condition.

When provided as a seat, the support member may include a layer of cushioning material, and may also have a cover which is wrapped around it. Separable means such as a hook and loop combination can be provided to hold the ends of the cover in the installed condition, subject to ready release when the cover is to be replaced.

The length of the seat rails can be made shorter or longer, depending on how many support members (one or more) are to be supported on the seat rails.

Optionally a back rail is attached to and extends between the end panels. Its purpose is to support a back rest. The back rest includes two studs, and the back rest rail has two ports in which the studs fit to resist torque and rotation of the back rest. Retention means passes through the back rail into the back rest releasably to hold it in place. A removable cover can be wrapped around the back rest.

The above and other features of this invention will be fully understood from the following detailed description and the accompanying drawings, in which:

DETAILED DESCRIPTION OF THE INVENTION

Figure 1:
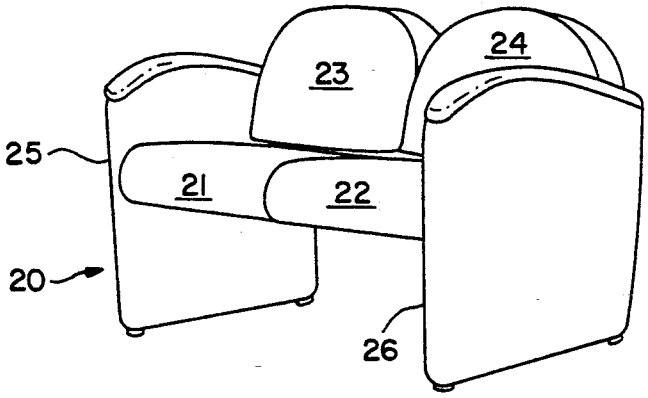
FIG. 1 is a perspective view of one embodiment of the invention with two support means.
Figure 2:
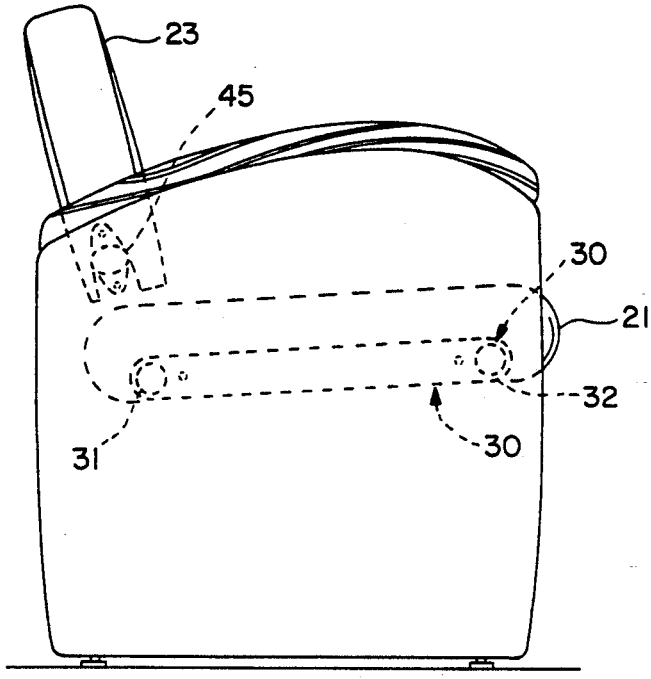
FIG. 2 is a right hand elevation of the embodiment of FIG. 1.
Figure 3:
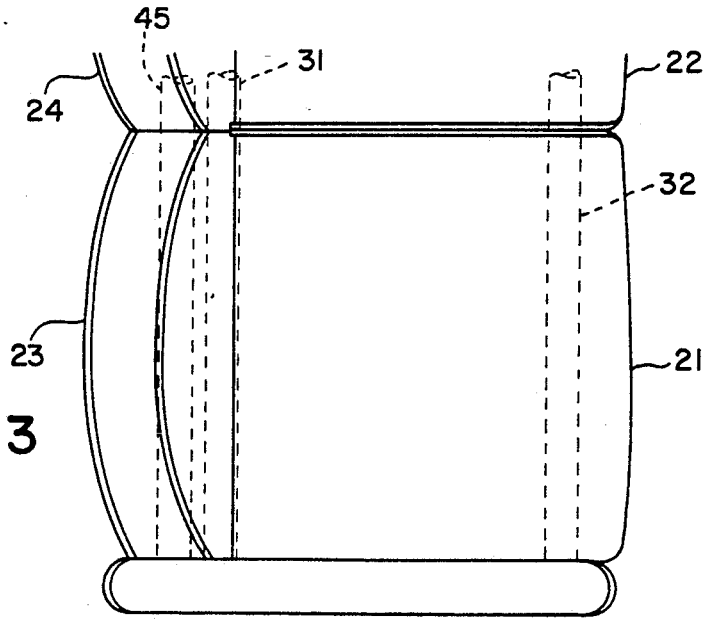
FIG. 3 is a plan view of FIG. 2.

The presently preferred embodiment of this invention is shown in FIG. 1. It is an article 20 of furniture for seating purposes. In this embodiment, the article has two support members 21,22 and two back rests 23,24. This provides seating for two persons. Should more or less capacity be desired, the width can be shortened to accommodate only one support member. Should more than two be desired, the width can be lengthened to accommodate more. Usually no more than three will be provided. Should more than three be desired, the article can be supplemented as will later be shown.

This is not an adjustable article. As will later be seen, should a different number of support members be desired, a seat rail frame of a different length will be used. However, all other elements of this furniture will remain unchanged—only more or fewer of some of them will be provided.

End panels 25,26 support the article at each of its ends. The bottoms 27,28 of these panels are to rest on a floor.

Figure 7:
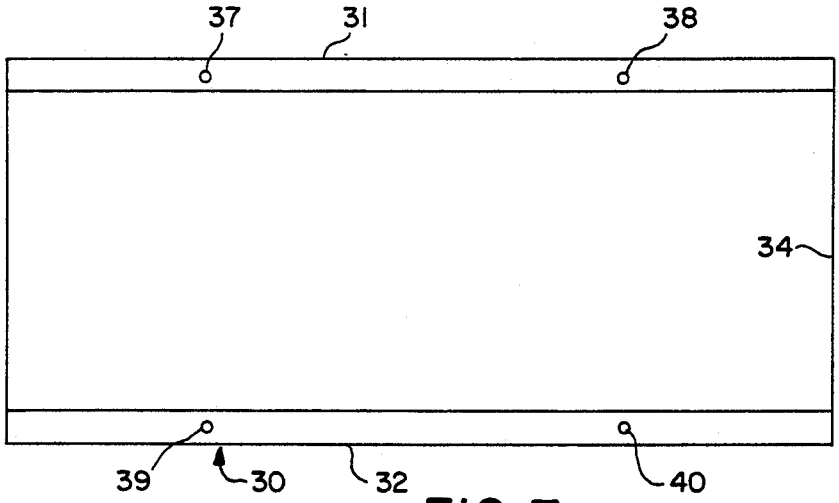
FIG. 7 is a top view of a seat rail element used in the article of FIG. 1.
Figure 8:
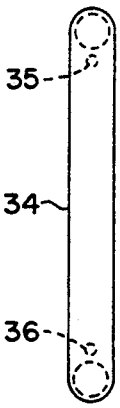
FIG. 8 is a right hand view of FIG. 7, the other end view being its mirror image.

A seat rail frame 30 (FIG. 7) comprises a pair of parallel linear seat rails 31,32 welded to a pair of parallel end plates 33,34. These end plates have a substantial planar bearing area around and on each side of a pair of attachment holes 35,36. The end plates are normal to the rails. The seat rail frame is therefore a rigid rectangular structure.

Attachment holes 37,38,39,40 are formed through the rails, one in each rail for each support member.

Frequently the article will be provided as a bench, and then only the seat rail will be used. Should back rests be desired, then a back rest rail 45 will also be used. As shown, it has a pair of end plates 46,47, to which it is welded. The end plates have attachment holes 48,49 through them, and provide a substantial planar area for a purpose which will become evident. The end plates are normal to the back rest rail. All of the rails are preferably made from steel tubing, and the end plates from steel plate. While circular-sectioned tubing is generally to be preferred, square-sections or other suitable sections can also or instead be used.

The back rest rail itself has attachment holes 50,51, one for each support member. In addition it has a pair of ports 52,53 and 54,55 one pair for each support element, to receive a stud which will later be described.

Figure 9:
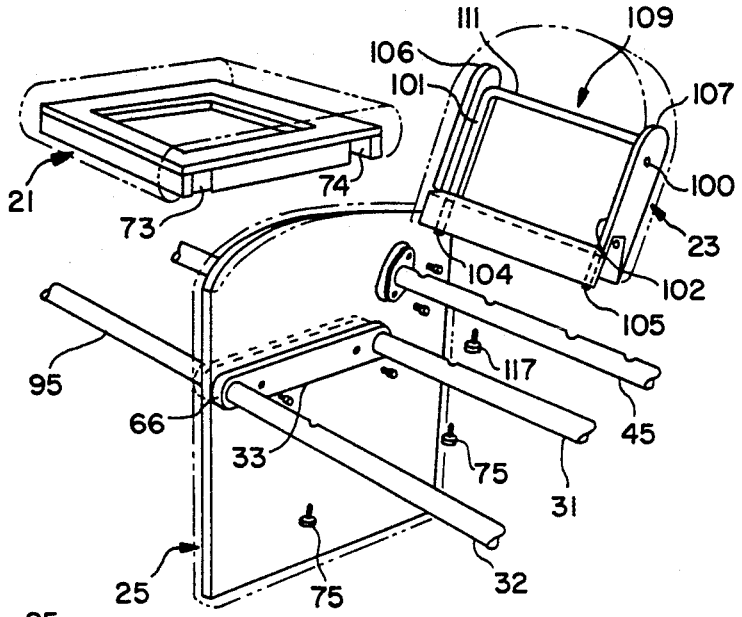
FIG. 9 is an exploded view of half of FIG. 1, further modified to permit extension of the furniture.
Figure 10:
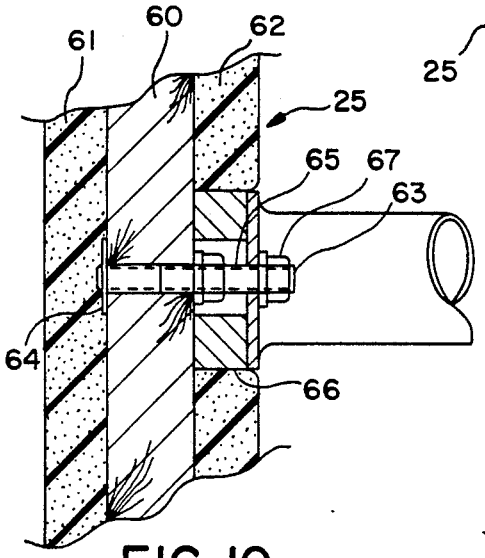
FIG. 10 is a fragmentary cross-section showing one type of attachment means for the seat rail element.
Figure 11:
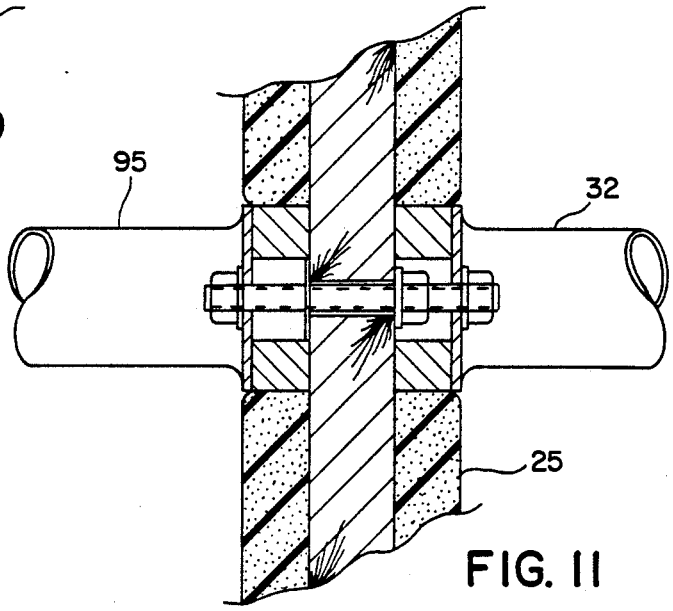
FIG. 11 shows a modification of the attachment means of FIG. 10 to attach a next article of furniture.

The structure beneath the upholstery in the end panel is best shown in FIGS. 9–11. A core sheet 60 of hardwood has on each of its sides a layer 61,62 of flexible elastic material such as polyurethane foam. A fastener 63 is a T-nut that has a flange 64 that bears against one side of the core sheet, and passes through a hole in it to provide a threaded stud 65 which passes through a rigid plate-like spacer 66. A respective end plate is brought to bear against a complementary surface or the spacer, and this provides a strong retention of the seat rail frame to the end panels. A lock nut 67 will be used to protect against loosening of this joint.

Similar attachment means is provided for the back rail when one is used.

It will now be seen that all structure except the rails is common for any application. To provide for a different number of support members, a rail frame with a proper length for that number will be used. This greatly reduces inventory and installation problems.

The end panels may be upholstered as desired with foam, cloth, plastic, or any other suitable material.

Figure 4:
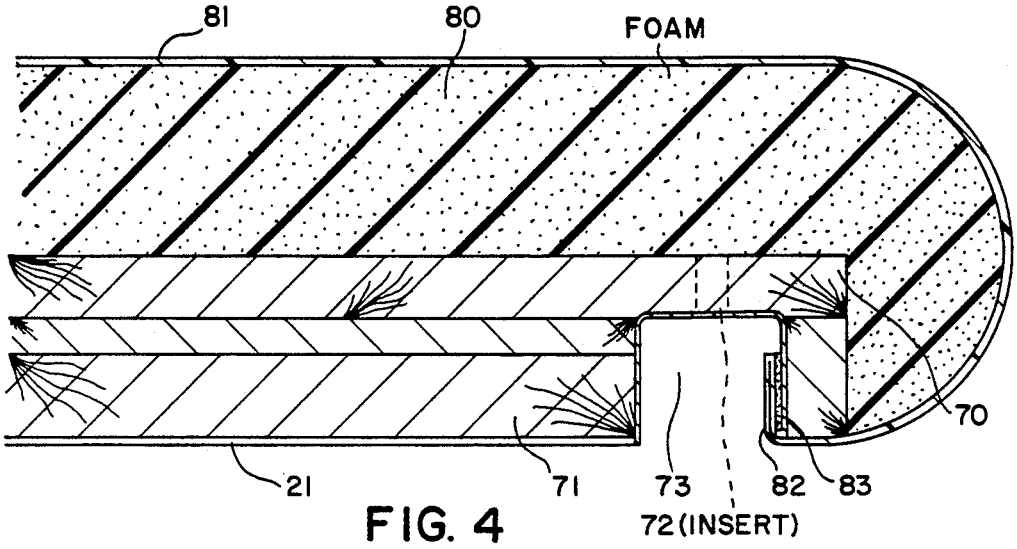
FIG. 4 is a half section of a support member according to this invention.
Figure 5:
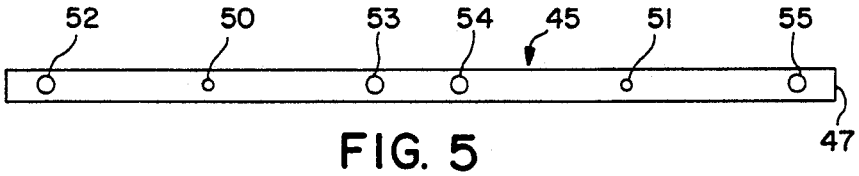
FIG. 5 is a top view of a back rail used in the article of FIG. 1.
Figure 6:
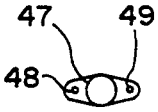
FIG. 6 is a right hand view of FIG. 5, the other end view being its mirror image.

A typical support element 21 for a seat is best shown in FIGS. 4 and 9. A plate 70 of hardwood surmounts an underlying filler frame 71 of less expensive material such as chipboard or plywood. A threaded T-nut insert 72 is fitted in plate 70 atop each pair of metal channel members 73,74 which extend from edge to edge of the support member. There is one of these channel members for each seat rail. The channel members face downwardly so the rails can fit into them to hold the support member in place. Attachment means such as headed bolts 75 pass through attachment holes 37 and 39 into inserts 72 to hold the support member to the seat rails.

Padding 80 can be placed around plate 70 for comfort. A cover 81 is wrapped around the padding. A convenient means for detachably putting it in place is by layers 82,83 of hook and loop fabric at overlapping ends of the cover. These ends will preferably be placed in the groove so as to be unavailable unless and until the support member is removed from the seat rails. The seat rail will shield these ends when in place. Similar arrangements are provided at both grooves.

FIG. 11 shows a modification of FIGS. 9 and 10 so that end panel 25 can function as an intermediate panel instead of as a terminal panel. As can be seen, a second seat rail frame 95 can be attached by the same type of fastener to the other side of the panel, merely by duplicating the attachment means on the other side. Thus, this article can be indefinitely extended.

Figure 12:
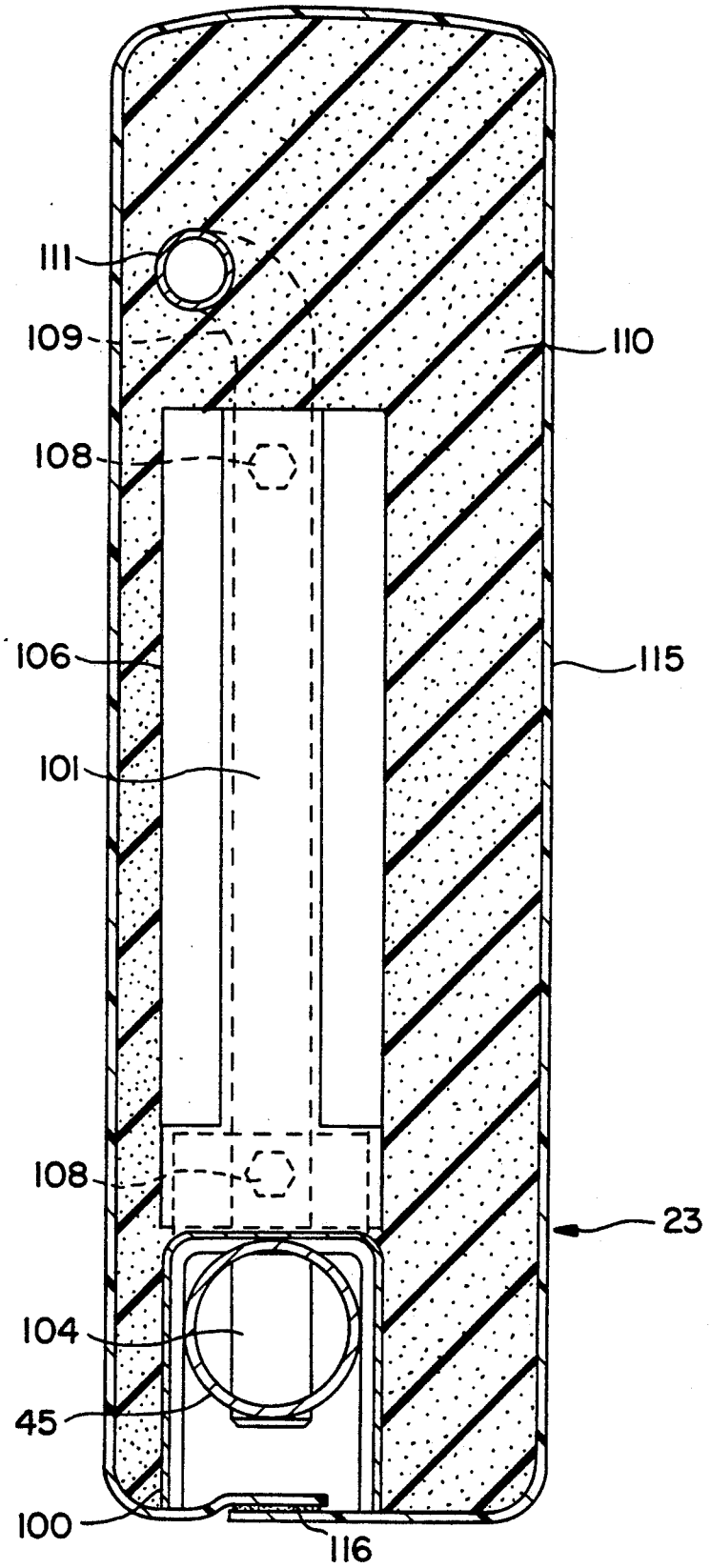
FIG. 12 is a cross-section showing a means for mounting a back rest to a back rail.

Back rest 23 is shown in greater detail in FIGS. 9 and 12. It has a channel member 100, preferably metal, to which two legs 101 and 102 of a hoop like frame member 109 are attached, and from which studs 104 and 105 continue. It is these studs which fit into ports 51 and 52 to resist torque on the back rest. End plates 106,107 are attached by fasteners 108 to respective legs of frame member 109. This provides a hollow structure in which padding or foam 110 can be placed. Bight 111 interconnects the legs, and also provides central support for the back rest. A cover 115 is wrapped around the padding. It is secured by hook and loop material 116 at its ends.

Fasteners 117 are passed through holes 50,51 to hold the back rest rail in the channel.

When the support member is to be a table rather than a seat, it will be surfaced appropriately. In some arrangements, when seats and tables are to be interspaced, an intermediate arm member may be supplied. Also, tables can be cantilever from end panels, if desired to provide this amenity outside of the seating region.

This invention thereby provides an article of furniture adaptable with only minor changes in a frame, to a wide variety of user configurations. Its construction is very rugged, and its covers can readily be removed and replaced, but only by authorized persons.

This invention is not to be limited by the embodiments shown in the drawings and described in the description, which are given by way of example and not of limitation, but only in accordance with the scope of the appended claims.

I claim:

1. An article of furniture comprising:

a seat rail frame including a pair of parallel linear seat rails, a pair of end plates fixed to said rails at respective ends thereof, said end plates being normal to said rails, and with said rails forming said seat rail frame as a rigid rectangular structure;

a pair of rigid end panels, each adapted to rest on a surface and having an area complementary to a respective end frame;

first attachment means attaching said end plates to respective end panels;

at least one support member, said support member comprising a rigid plate and a pair of channel means fixed to said rigid plate and opening away from it, said channel means being so disposed and arranged as to receive a respective seat rail for support by said seat rail; and second attachment means attaching said support member to each of said rails.

2. An article of furniture according to claim 1 in which said rails have a hole therethrough to pass said second attachment means, said second attachment means being a headed and threaded fastener threaded into said support member.

3. An article of furniture according to claim 1 in which said channel means is a metal channel proportioned closely to embrace a respective seat rail.

4. An article of furniture according to claim 1 in which a flexible cover is wrapped around said support member, and held at its ends by releasable hook and loop material disposed in a said channel when the support member is placed on said seat rails.

5. An article of furniture according to claim 1 in which a linear back rest rail with a pair of end plates rigidly attached to it extends between said end panels and is attached to them.

6. An article of furniture according to claim 5 in which the back rest rail includes a pair of ports, and in which a back rest is attached to said back rest rail, said back rest comprising a hoop like frame member with a pair of legs and a bight, a stud-like end of each leg fitting closely into a respective said port to resist torque on the frame, and third attachment means to hold the back rest to the back rest rail.

7. An article of furniture according to claim 6 in which said back rest includes a channel member so disposed and arranged as to receive said back rest rail.

8. An article of furniture according to claim 5 in which all of said rails are metal tubes.

9. An article of furniture according to claim 1 in which said rails are metal tubes.

* * * * *